US005735291A

United States Patent [19]

Kaonohi

[11] Patent Number: 5,735,291

[45] Date of Patent: Apr. 7, 1998

[54] HOT WATER RE-CIRCULATING SYSTEM

[76] Inventor: Godfrey K. Kaonohi, 47-641 Uakea Pl., Kaneohe, Hi. 96744

[21] Appl. No.: 576,010

[22] Filed: Dec. 21, 1995

[51] Int. Cl.[6] ..... F16L 5/00

[52] U.S. Cl. ..... 137/337; 137/566; 137/624.11; 126/362; 417/12

[58] Field of Search ..... 137/337, 566, 137/624.11, 565; 417/12, 32; 126/362

[56] References Cited

U.S. PATENT DOCUMENTS

| | | | |
|---|---|---|---|
| 372,232 | 10/1887 | Newman . | |
| 3,097,661 | 7/1963 | Lee | 137/335 |
| 3,885,584 | 5/1975 | Hock | 137/334 |
| 4,750,472 | 6/1988 | Fazekas | 126/362 |
| 4,917,142 | 4/1990 | Laing et al. | 137/566 |
| 4,945,942 | 8/1990 | Lund | 126/362 |
| 5,240,179 | 8/1993 | Drinkwater | 417/12 |
| 5,261,443 | 11/1993 | Walsh | 126/362 |
| 5,277,219 | 1/1994 | Lund | 126/362 |
| 5,331,996 | 7/1994 | Ziehm | 137/337 |

*Primary Examiner*—A. Michael Chambers
*Attorney, Agent, or Firm*—Michael I. Kroll

[57] ABSTRACT

A hot water re-circulating system (10) in a building (12) comprising a water pump (36) connected between an auxiliary water return line (28) extending from a hot water faucet (22) to a remote hot water heater (14). The water pump (36) is controlled by a timer/switch (42) located at the hot water faucet (22), so that when the hot water faucet (22) is opened, hot water will come out therefrom. In a second embodiment, two water pumps (82) and (92) are each connected between two auxiliary water return lines (68) and (70) extending from two hot water faucets (58) and (62) to a remote hot water heater (50). Each water pump (82) and (92) is controlled by a timer/switch (88) and (98) located at the hot water faucets (58) and (62), so that when the hot water faucets (58) and (62) are opened, hot water wall come out therefrom.

5 Claims, 2 Drawing Sheets

64
98
62
78
66
70
88
58
74
60
100
68
66
90
48
76
92
94
72
84
54
96
82
46
52
86
80
56
50

70
68
94
84
46
100
92
76
72
90
102
82
66
96
86
80
52
56
54
50

HOT WATER RE-CIRCULATING SYSTEM

BACKGROUND OF THE INVENTION

1. Field of the Invention

The instant invention relates generally to hot water supply heating units and more specifically it relates to a hot water re-circulating system.

2. Description of the Prior Art

Numerous hot water supply heating units have been provided in prior art. For example, U.S. Pat. Nos. 372,232 to Newman; 3,097,661 to Lee; 3,885,584 to Hock and 5,331,996 to Ziehmall are illustrative of such prior art. While these units may be suitable for the particular purpose to which they address, they would not be as suitable for the purposes of the present invention as heretofore described.

NEWMAN, EDWIN A.

APPARATUS FOR REGULATING THE TEMPERATURE AND FLOW OF WATER IN PIPES

U.S. Pat. No. 372,232

The combination, with the hot water pipes of a building and a separate system of cold water pipes, of an interposed valve communicating only with the hot and cold water pipes. Communication may be opened or closed between the pipes and a circulation of hot water in the cold water pipes effected, for the purpose described, without drawing or discharging water from the pipe system. Independent cocks or faucets are for drawing the water from the pipes.

LEE, JOHN W. G.

INSTANT HOT WATER SYSTEM

U.S. Pat. No. 3,097,661

A water heating and circulating system for a building having double walls comprising a hot water heater. A hot water supply line is connected to the top of the heater and includes a horizontal run section. Risers in the wall are connected to the horizontal run section and extend to a level above the heater. Outlets are on the risers. A return line includes downcomers in the walls extending to a level above the heater. Return bends connect the upper ends of the risers to the upper ends of the downcomers, a horizontal run section to which the lower ends of the downcomers are connected, and a riser connecting the last mentioned horizontal run section adjacent the bottom of the heater. A check valve is in the last mentioned riser immediately before its connection to the heater. The check valve allows flow from the return line into the heater and prevents flow from the heater into the return line. The return line has a smaller cross sectional area than the hot water supply line, the risers, the hot water supply line and a major portion of the return line are insulated against heat dissipation. A minor portion of the return line includes part of the last mentioned horizontal run section and the last mentioned riser being free from insulation.

HOCK, WALTER L.

HOT WATER SYSTEM

U.S. Pat. No. 3,885,584

Apparatus and control therefore senses the temperature of water at a hot water line discharge point and, upon activation, causes the line to drain until water of a pre-selected temperature reaches the discharge point. Further apparatus is provided in combination to blend warm water of an initial pre-selected temperature with cooler water in a predetemined proportion, to provide a continuing discharge of warm water in a comfortable temperature range for human convenience.

ZIEHM, RAYMOND G.

DUAL MODE HOT WATER CIRCULATION APPARATUS

U.S. Pat. No. 5,331,996

A dual mode water circulation apparatus to provide instantaneous hot water to faucets remote from the heater in residential or small commercial building water systems. The apparatus comprises a cold water heat exchanger, a high sensitivity check valve, and a aspirator incorporated into a single unit. The heat exchanger is a chamber installed in the cold water supply line, containing a cooling tube exposed to the water. The check valve has a neutral buoyancy poppet and closes against an angular seat. The aspirator has a reduced cross section nozzle inside a tapered chamber connected to the water supply pipe, with a low pressure tap in the chamber bore. The apparatus is installed at an angle to the horizontal. The cooling tube is connected to a water return line from a tee in the hot water pipe at the remote faucet. The water circulation loop is from the remote hot water faucet to the heat exchanger portion of the apparatus, to the check valve, then to the aspirator and into the cold water supply to the heater. A continuous, low rate convective flow is induced in the loop by the heat exchanger, and a higher rate aspirated flow is present whenever water is used in the building. The apparatus is self regulating in response to user needs.

SUMMARY OF THE INVENTION

A primary object of the present invention is to provide a hot water re-circulating system that will overcome the shortcomings of the prior art devices.

Another object is to provide a hot water re-circulating system that will avoid wasting hot water which is left standing in a hot water line when a hot water faucet is closed by re-circulating the cooled down hot water back into a remote hot water heater.

An additional object is to provide a hot water re-circulating system that utilizes at least one pump connected between an auxiliary return line extending from the hot water faucet to the remote hot water heater, in which the pump is controlled by a timer/switch located at the hot water faucet, so that when the hot water faucet is opened hot water will come out therefrom.

A further object is to provide a hot water re-circulating system that is simple and easy to use.

A still further object is to provide a hot water re-circulation system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
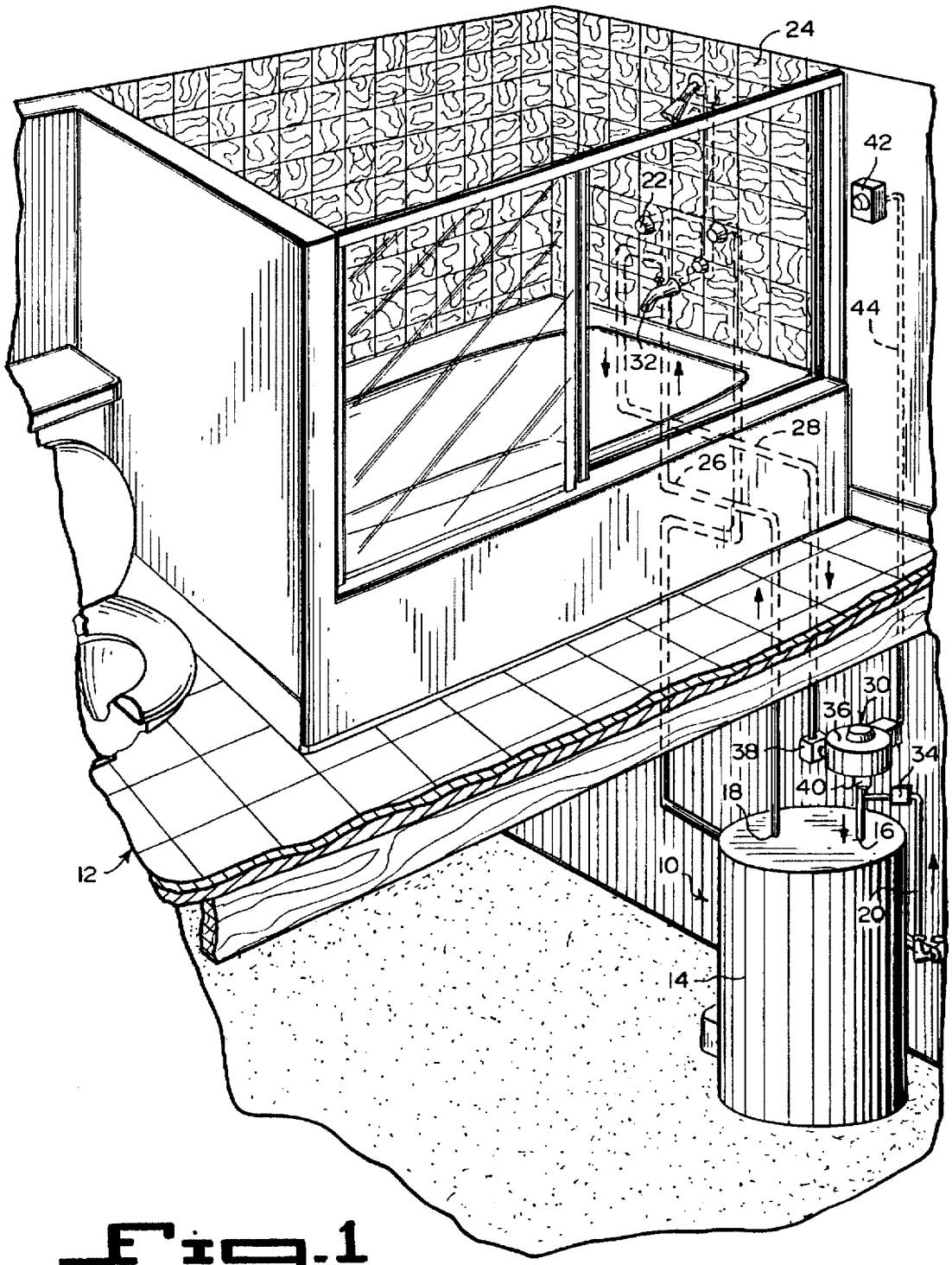
FIG. 1 is a perspective view with parts broken away and in section of a first embodiment of the instant invention installed in a building.

Turning now descriptively to the drawings, in which similar reference characters denote similar elements throughout the several views, FIG. 1 illustrates a hot water re-circulating system 10 in a building 12, comprising a hot water heater 14 located in the building 12. The hot water heater 14 has a cold water inlet port 16 and a hot water outlet port 18. A cold water feed line 20 is connected to the cold water inlet port 16. A hot water faucet 22 is located in the building 12 remotely from the hot water heater 14, such as in a bath and shower unit 24.

A hot water supply line 26 extends between the hot water outlet port 18 of the hot water heater 14 and the hot water faucet 22. An auxiliary water return line 28 extends between the hot water supply line 26 adjacent the hot water faucet 22 and the cold water inlet port 16 of the hot water heater 14. A facility 30 in the auxiliary water return line 38 is for re-circulating cool water standing in the hot water supply line 26, when the hot water faucet 22 is closed, back into the hot water heater 14 through the cold water inlet port 16. When the hot water faucet 22 is opened, hot water will immediately exit through a spout 32 in the bath and shower unit 24, which is fluidly connected to the hot water faucet 22.

A check valve 34 is in the cold water feed line 20, to allow cold water to flow into the hot water heater 14. The check valve 34 will also prevent a back flow of water out of the cold water inlet port 16 of the hot water heater 14 into the cold water feed line 20.

The re-circulating facility 30 includes an electrically operated water pump 36. A first check valve 38 is in the auxiliary water return line 28 between the hot water faucet 22 and the water pump 36. A second check valve 40 is in the auxiliary water return line 28, between the cold water inlet port 16 of the hot water heater 14 and the water pump 36. This allows cool water to be pumped into the water heater 14 and prevents a back flow of water out of the cold water inlet port 16 of the hot water heater 14, through the water pump 36 and into the auxiliary water return line 28.

A timer/switch 42 is located adjacent the hot water faucet 22 next to the bath and shower unit 24. An electrical wire 44 extends between the water pump 36 and the timer/switch 42. When the timer/switch 42 is turned on, the water pump 36 will be activated to re-circulate the cool water back into the hot water heater 14 and bring hot water from the hot water heater 14 up through the hot water supply line 26 to the hot water faucet 22.

Figures 2, 3:
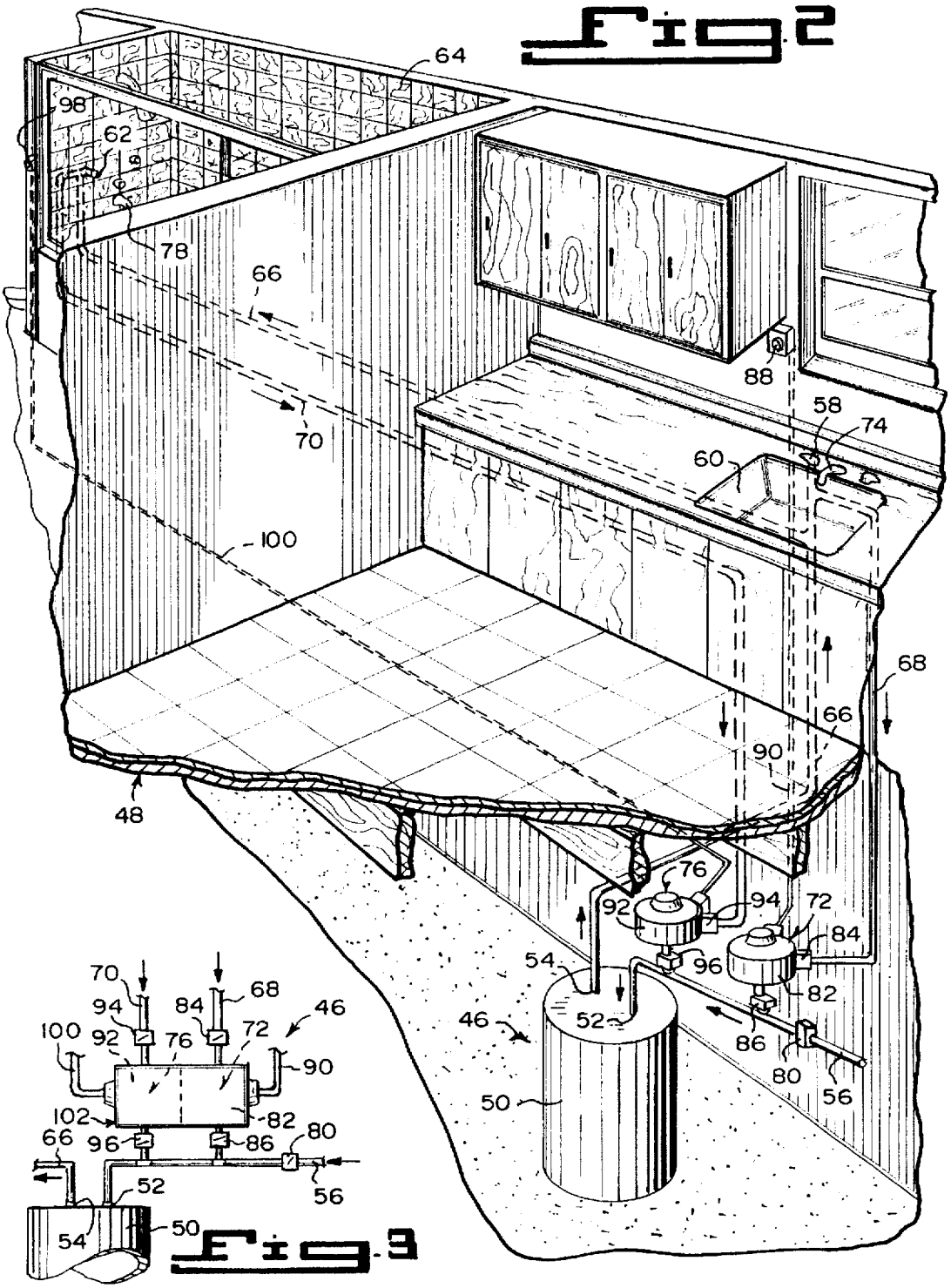
FIG. 2 is a perspective view with parts broken away and in section of a second embodiment of the instant invention installed in a building.
FIG. 3 is an elevational view with parts broken away and in section of a portion of a third embodiment of the instant invention.

FIG. 2 shows a hot water re-circulating system 46 in a building 48 comprising a hot water heater 50 located in the building 46. The hot water heater 50 has a cold water inlet port 52 and a hot water outlet port 54. A cold water feed line 56 is connected to the cold water inlet port 52 of the hot water heater 50. A first hot water faucet 58 is located in the building 48 remotely from the hot water heater 50, such as in a kitchen sink 60.

A second hot water faucet 62 is located in the building 48 remotely from the hot water heater 50, such as in a bath and shower unit 64. A hot water supply line 66 extends between the hot water outlet port 54 of the hot water heater 50 and the first and second hot water faucets 58 and 62. A first auxiliary water return line 68 extends between the hot water supply line 66 adjacent the first hot water faucet 58 and the cold water inlet port 52 of the hot water heater 50. A second auxiliary water return line 70 extends between the hot water supply line 66 adjacent the second hot water faucet 62 and the cold water inlet port 52 of the hot water heater 50.

A first facility 72 in the first auxiliary water return line 68 is for re-circulating cool water standing in the hot water supply line 66, when the first hot water faucet 58 is closed, back into the hot water heater 50 through the cold water inlet port 52. When the first hot water faucet 58 is opened, hot water will immediately exit through a first spout 74 in the kitchen and sink 60, which is fluidly connected to the first hot water faucet 58. A second facility 76 in the second auxiliary water return line 70 is for re-circulating cool water standing in the hot water supply line 66, when the second hot water faucet 62 is closed, back into the hot water heater 50 through the cold water inlet port 52. When the second hot water faucet 62 is opened, hot water will immediately exit through a second spout 78 in the bath and shower unit 64, which is fluidly connected to the second hot water faucet 62.

A check valve 80 is in the cold water feed line 56, to allow cold water to flow into the hot water heater 50. The check valve 80 will also prevent a back flow of water out of the cold water inlet port 52 of the hot water heater 50 into the cold water feed line 56.

The first re-circulating facility 72 includes a first electrically operated water pump 82. A first check valve 84 is in the first auxiliary water return line between the first hot water faucet 58 and the first water pump 82. A second check valve 86 is in the first auxiliary water return line 68 between the cold water inlet port 52 of the hot water heater 50 and the first water pump 82. This allows cool water to be pumped into the water heater 50 and prevents a back flow of water out of the cold water inlet port 52 of the hot water heater 50, through the first water pump 82 and into the first auxiliary water return line 68.

A first timer/switch 88 is located adjacent the first hot water faucet 58 at the kitchen sink 60. A first electrical wire 90 extends between the first water pump 82 and the first timer/switch 88. When the first timer/switch 88 is turned on, the first water pump 82 will be activated to re-circulate the cool water back into the hot water heater 50 and bring hot water from the hot water heater 50 up through the hot water supply line 66 to the first hot water faucet 58.

The second re-circulating facility 76 includes a second electrically operated water pump 92. A third check valve 94 is in the second auxiliary water return line 70 between the second hot water faucet 62 and the second water pump 92. A fourth check valve 96 is in the second auxiliary water return line 70 between the cold water inlet port 52 of the hot water heater 50 and the second water pump 92. This allows cool water to be pumped into the water heater 50 and prevents a back flow of water out of the cold water inlet port 52 of the hot water heater 50, through the second water pump 92 and into the second auxiliary water return line 70.

A second timer/switch 98 is located adjacent the second hot water faucet 62, next to the bath and shower unit 64. A second electrical wire 100 extends between the second water pump 92 and the second timer/switch 98. When the second timer/switch 98 is turned on, the second water pump 92 will be activated to re-circulate the cool water back into the hot water heater 50 and bring hot water from the hot water heater 50 up through the hot water supply line 66 to the second hot water faucet 62.

In FIG. 3, the hot water re-circulating system 46 further includes a housing unit 102, for maintaining the first water 82 and the second water pump 92 in a side by side independent relationship. All other components are the same as shown in FIG. 2, and function as described above.

LIST OF REFERENCE NUMBERS

10 hot water re-circulating system in 12
12 building
14 hot water heater of 10
16 cold water inlet port of 14
18 hot water outlet port of 14
20 cold water feed line of 10
22 hot water faucet of 10
24 bath and shower unit in 12
26 hot water supply line of 10
28 auxiliary water return line of 10
30 re-circulating facility of 10 in 28
32 spout in 24
34 check valve in 20
36 electrically operated water pump of 30
38 first check valve in 28 between 22 and 36
40 second check valve in 28 between 16 and 36
42 timer/switch adjacent 22
44 electrical wire between 36 and 42
46 hot water re-circulating system in 48
48 building
50 hot water heater of 46
52 cold water inlet port of 50
54 hot water outlet port of 50
56 cold water feed line of 46
58 first hot water faucet of 46
60 kitchen sink in 48
62 second hot water faucet of 46
64 bath and shower unit in 48
66 hot water supply line of 46
68 first auxiliary water return line of 46
70 second auxiliary water return line of 46
72 first re-circulating facility of 46 in 68
74 first spout in 60
76 second re-circulating facility of 46 in 70
78 second spout in 64
80 check valve in 56
82 first electrically operating water pump of 72
84 first check valve in 68 between 58 and 82
86 second check valve in 68 between 52 and 82
88 first timer/switch adjacent 58
90 first electrical wire between 82 and 88
92 second electrically operated water pump of 76
94 third check valve in 70 between 62 and 92
96 fourth check valve in 70 between 52 and 92
98 second timer/switch adjacent 62
100 second electrical wire between 92 and 96

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hot water re-circulating system in a building comprising:

a) a hot water heater located in the building, said hot water heater having a cold water inlet port and a hot water outlet port;

b) a cold water feed line connected to said cold water inlet port of said hot water heater;

c) a first hot water faucet located in the building remotely from said hot water heater;

d) a second hot water faucet located in the building remotely from said hot water heater;

e) a hot water supply line extending between said hot water outlet port of said hot water heater and said first and second hot water faucets;

f) a first auxiliary water return line extending between said hot water supply line adjacent said first hot water faucet and said cold water inlet port of said hot water heater;

g) a second auxiliary water return line extending between said hot water supply line adjacent said second hot water faucet and said cold water inlet port of said hot water heater;

h) means in said first auxiliary water return line comprising a first electrically operated pump for re-circulating cool water standing in said hot water supply line, when said first hot water faucet is closed, back into said hot water heater through said cold water inlet port, so that when said first hot water faucet is opened, hot water will immediately exit through a first spout fluidly connected to said first hot water faucet;

i) means in said second auxiliary water return line comprising a second electrically operated water pump for re-circulating cool water standing in said hot water supply line when said second hot water faucet is closed, back into said hot water heater through said cold water inlet port, so that when said second hot water faucet is opened hot water will immediately exit through a second spout fluidly connected to said second hot water faucet; and j) first/timer switch means located adjacent said first hot water faucet upon actuation for energizing said first electrically operated pump and second timer/switch means located adjacent said second hot water faucet upon actuation for energizing said second electrically operated pump to re-circulate the cool water in the first or second auxiliary water return line back into said hot water heater and bring hot water from said hot water heater up through the hot water supply line to the faucet corresponding to the actuated timer/switch means.

2. A hot water re-circulating system as recited in claim 1, further including a check valve in said cold water feed line, to allow cold water to flow into said hot water heater and to prevent a back flow of water out of said cold water inlet port of said hot water heater into said cold water feed line.

3. A hot water re-circulating system as recited in claim 2, wherein said first re-circulating means further includes:

a) a first check valve in said first auxiliary water return line between said first hot water faucet and said first water pump; and b) a second check valve in said first auxiliary water return line between said cold water inlet port of said hot water heater and said first water pump, to allow cool water to be pumped into said water heater and to prevent a back flow of water out of said cold water inlet port of said hot water heater, through said first water pump and into said first auxiliary water return line.

4. A hot water re-circulating system as recited in claim 3, wherein said second re-circulating means further includes:

a) a third check valve in said second auxiliary water return line between said second hot water faucet and said second water pump; and b) a fourth check valve in said second auxiliary water return line between said cold water inlet port of said hot water heater and said second water pump, to allow cool water to be pumped into said water heater and to prevent a back flow of water out of said cold water inlet port of said hot water heater, through said second water pump and into said second auxiliary water return line.

5. A hot water re-circulating system as recited in claim 4, further including a housing unit for maintaining said first water pump and said second water pump in a side by side independent relationship.

* * * * *